US006003498A

United States Patent [19]

Reddy

[11] Patent Number: 6,003,498

[45] Date of Patent: Dec. 21, 1999

[54] CANISTER PURGE CONTROL STRATEGY

[75] Inventor: Sam Raghuma Reddy, West Bloomfield, Mich.

[73] Assignee: General Motors Corporation, Detroit, Mich.

[21] Appl. No.: 08/935,978

[22] Filed: Sep. 23, 1997

[51] Int. Cl.[6] ..... F02M 33/02

[52] U.S. Cl. ..... 123/520; 123/516

[58] Field of Search ..... 123/520, 521, 123/519, 518, 516, 198 D, 357

[56] References Cited

U.S. PATENT DOCUMENTS

| | | | |
|---|---|---|---|
| 4,748,959 | 6/1988 | Cook et al. . | |
| 4,809,667 | 3/1989 | Uranishi | 123/520 |
| 4,862,856 | 9/1989 | Yokoe | 123/520 |
| 5,088,466 | 2/1992 | Tada | 123/520 |
| 5,343,760 | 9/1994 | Sultan et al. . | |
| 5,351,193 | 9/1994 | Poirier et al. . | |
| 5,474,049 | 12/1995 | Nagaishi | 123/520 |
| 5,535,725 | 7/1996 | Baker | 123/520 |
| 5,549,094 | 8/1996 | Tomisawa | 123/520 |
| 5,596,972 | 1/1997 | Sultan et al. . | |

*Primary Examiner*—Carl S. Miller
*Attorney, Agent, or Firm*—Vincent A. Cichosz

[57] ABSTRACT

A canister purge control strategy in which canister purge operation is adjusted when operating conditions normally identified as leading to purge system deterioration are present, such as high humidity operating conditions and operating conditions in which the fuel vapor canister is substantially fully purged. High humidity conditions, as are present during rainy conditions or inside a vehicle car wash, are detected by monitoring hardware normally available on the vehicle, such as a wiper switch state and a transmission gear state. Canister purging is adjusted or deactivated as a function of wiper switch state and transmission gear state to prevent moisture from entering the fuel vapor canister and reducing the capacity of the fuel adsorbing material. A substantially fully purged fuel vapor canister is detected by estimating a level of fuel vapor contained in the canister as a function of a change in injector pulse width under closed-loop control before and after canister purge is enabled. Canister purging is then adjusted or deactivated as a function of the estimated level of fuel vapor to prevent unnecessary purge system component wear and extend purge system component life.

6 Claims, 2 Drawing Sheets

CANISTER PURGE CONTROL STRATEGY

TECHNICAL FIELD

This invention relates to automotive evaporative emission controls, and more specifically, to a canister purge control strategy to prevent deterioration of canister purge system components.

BACKGROUND OF THE INVENTION

Canister purge systems are generally used in the automotive industry to reduce automotive evaporative emissions by controlling the amount of fuel vapor released into the atmosphere from a vehicle's fuel supply, such as a fuel tank. Fuel vapor from the fuel supply is guided to and trapped in a collection canister containing a fuel vapor adsorbing material, such as activated carbon. The term "adsorbing" refers to the process of using solid particles to store fuel vapor, in comparison to the term "absorbing," which refers to the process of using a liquid to store fuel vapor. Fuel vapor is drawn out of the adsorbing material and into a low pressure intake chamber of the engine through a passage containing a purge control valve.

The purge control valve is normally closed, whereby the fuel vapor is retained within the canister. Periodically, when canister purging is required, the purge control valve is driven to an open position through application of an appropriate control signal to an actuator mechanically linked to the purge control valve. When the purge control valve is open and the engine is running, ambient air passing through a canister vent valve and across the canister to the relatively low pressure engine intake chamber draws fuel vapor from the fuel vapor adsorbing material into the engine intake chamber for ingestion in the combustion process.

Purge control strategies have been proposed in which the canister purge system is purged irrespective of system operating conditions. Such strategies can lead to purge system deterioration. For example, purging an empty canister contributes to purge system component wear and reduced purge system component life. Similarly, purging during high humidity conditions, such as when the air contains water molecules or water mist, draws moisture through the vent valve into the canister. Moisture in the canister can deteriorate the working capacity of the fuel vapor adsorbing material within the canister.

It would therefore be desirable to adjust canister purging under operating conditions known to lead to canister purge system deterioration. For example, it would be desirable to adjust or deactivate canister purging during periods of high humidity to prevent moisture intrusion and deterioration of the fuel vapor adsorbing material. Similarly, it would be desirable to adjust or deactivate canister purging when there is little or no vapor contained within the canister, preventing unnecessary purge system component wear and extending purge system component life.

SUMMARY OF THE INVENTION

The present invention overcomes the shortcomings of previous purge control strategies by adjusting canister purge operation when operating conditions normally identified as leading to purge system deterioration are present.

In accordance with a first aspect of this invention, the purge rate is adjusted during high humidity operating conditions to prevent moisture from entering the fuel vapor canister and reducing the capacity of the fuel vapor adsorbing material. High humidity operating conditions, such as rainy conditions, are detected by monitoring the state of a windshield wiper switch. When the windshield wiper switch indicates an active state, it is presumed that the vehicle is operating in a high humidity environment and the purge system is disabled to minimize moisture intrusion. On vehicles equipped with variable speed wiper systems, the state of the windshield wiper switch may indicate windshield wiper speed. In such a system, the purge rate is adjusted as a function of the indicated wiper speed, allowing the purge system to be selectively disabled only during periods of significant rainfall when moisture contamination of the fuel vapor adsorbing material is likely.

In accordance with a further aspect of this invention, a signal indicating the gear state of the vehicle's transmission is used to detect a further high humidity operating condition, such as may be present within a vehicle car wash. While a vehicle is in a car wash, the vehicle's transmission may be in a neutral gear. Accordingly, moisture intrusion is reduced by deactivating canister purge while the transmission is in a neutral gear.

In accordance with still a further aspect of this invention, the purge rate is adjusted as a function of the level of fuel vapor contained within the canister to prevent deterioration of system components due to purging a substantially empty canister. The level of fuel vapor contained within the canister is estimated by monitoring a closed-loop fuel injection rate before and after canister purging is enabled. If the closed-loop fuel injection rate changes little, for a given inlet air rate and desired air-fuel ratio, before and after canister purging is enabled, then the canister is assumed to be substantially fully purged and canister purge is disabled to minimize purge system deterioration.

In accordance with still a further aspect of this invention, the wiper state, transmission gear, and fuel vapor level are periodically monitored while canister purge is active, allowing for periodic adjustment or deactivation of the purge system in response to changes in operating conditions. For example, the purge rate may be selectively increased or decreased periodically in response to fluctuations in the level of fuel vapor contained within the canister.

BRIEF DESCRIPTION OF THE DRAWINGS

The invention may be best understood by reference to the preferred embodiment and to the drawings in which.

DESCRIPTION OF THE PREFERRED EMBODIMENT

Figure 1:
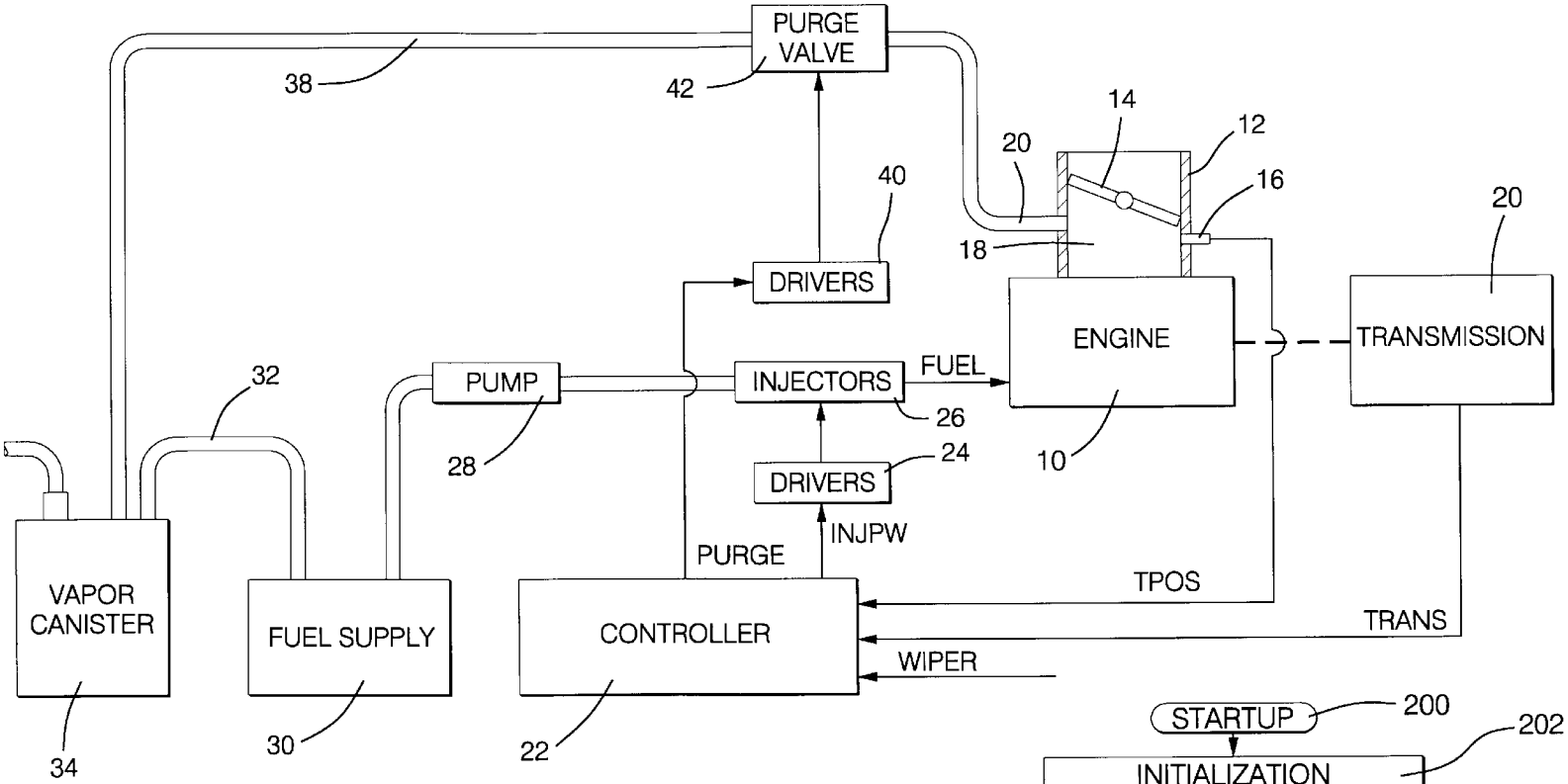
FIG. 1 is a general diagram of the engine hardware and controller in which this invention is carried out in accord with the preferred embodiment.

Referring to FIG. 1, internal combustion engine 10 receives intake air through intake air bore 12 in which is disposed intake air valve 14, such as a conventional butterfly throttle valve, for restricting the passage of intake air through intake air bore 12 to intake manifold 18, downstream of the intake air valve. The position of intake air valve 14 is sensed by a rotational potentiometric position sensor 16 having output signal TPOS. Engine fuel pump 28 draws fuel from a fuel supply 30, such as a fuel tank or any other fuel supply as is known in the art, and provides pressurized fuel to at least one conventional fuel injector 26 which is electronically controlled to meter fuel to the engine cylinder intake passages (not shown).

Fuel vapor evaporating from fuel supply 30 is guided through vapor conduit 32 which opens into a conventional fuel vapor canister 34 in which the fuel vapor is maintained. Fuel vapor canister 34 contains a fuel vapor adsorbing material, such as activated carbon or any other suitable vapor adsorbing material as is generally known in the art. Purge conduit 38 opens on a first end to fuel vapor canister 34 and on a second end, opposing the first end, into intake manifold 18. Purge valve 42, such as a conventional electronically controlled solenoid valve, is disposed in purge conduit 38. Purge valve 42 is controlled to selectively meter the flow of fuel vapor through conduit 38 and into engine intake manifold 18. When purge valve 42 is driven to an open position, fuel vapor canister 34 is exposed to intake manifold vacuum, drawing the trapped fuel vapors out of fuel vapor canister 34, through purge conduit 38 and into intake manifold 18. Inside intake manifold 18, the fuel vapor is mixed with intake air and distributed via the manifold to engine cylinder intake passages (not shown) where the mixture of intake air and purged fuel vapor is further combined with injected fuel for admission to the engine cylinders (not shown) where the mixture is consumed through the normal combustion process.

Engine control module (ECM) 22, such as a conventional sixteen bit microcontroller, is provided including conventional controller elements such as a central processing unit, read only memory, random access memory, input/output units, and other units generally known in the art to be used for vehicle control operations. The ECM 22 performs a series of procedures whereby input signals, such as TPOS, WIPER and TRANS, are sampled through conventional operations, such as conventional analog to digital converter sampling operations, and a series of actuator commands, such as PURGE and INJPW, are generated in response thereto for carrying out engine control operations.

More specifically, ECM 22 issues a pulse width modulated (PWM) control signal PURGE to purge valve driver 40, such as a conventional current control circuit, for driving the solenoid of purge valve 42 at a desired duty cycle for precise control of the amount of fuel vapor delivered to the engine intake manifold 18. The degree of opening of purge valve 42 varies as the magnitude of the desired duty cycle varies. ECM 22 determines a desired duty cycle as a function of predetermined vehicle parameters, to be described. Additionally, fuel injector drive command INJPW is output by ECM 22 to fuel injector driver 24. Fuel injector driver 24 issues a timed injector drive current signal to each of the individual injectors (not shown) to control the time of opening of the individual injectors and to accordingly control the corresponding amount of fuel delivered by each of the individual injectors to the respective engine cylinder intake passage (not shown), as is generally understood in the art. ECM 22 determines the fuel injector drive command as a function of desired air/fuel ratio and engine load in a manner generally understood in the art.

Figure 2:
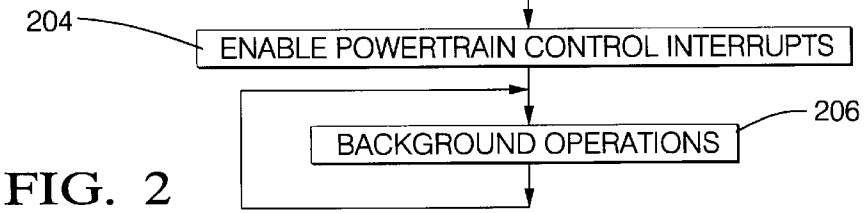
FIGS. 2–3 are computer flow diagrams illustrating the series of operations for carrying out the principles of this invention in accord with the preferred embodiment and the hardware of FIG. 1.

ECM 22 determines the desired purge control signal duty cycle through a series of procedures. These procedures may be stored in ROM as a series of software routines periodically executed while the ECM 22 is operating. Included with such routines is a general ECM start-up routine illustrated in FIG. 2. The start-up routine provides for general system initialization and the timing of execution of a plurality of control, diagnostic, and background subroutines. The start-up routine is initiated following start-up of the ECM 22, such as when a vehicle ignition key is rotated to its "on" position. The start-up routine proceeds from a step 200 to perform a general system initialization at a step 202. Initialization may include transferring constants from the ECM 22's read only memory locations to random access memory locations, initializing counters, pointers, and flags used for conventional controller functions, and other general start-up procedures.

After the initialization at step 202 is complete, powertrain control interrupts are enabled at a step 204. These interrupts may include time-based and event-based interrupts, as are generally understood in the art. Included in the interrupts of step 204 is a 100 millisecond purge control time-based interrupt. After enabling powertrain control interrupts at step 204, the routine proceeds to background operations at a step 206. Background operations may include maintenance and diagnostic operations that are continuously repeated while the ECM 22 is operating. The background operations of step 206 are of a relatively low priority, such that upon occurrence of an interrupt as enabled at step 204, the background operations will temporarily cease, and the ECM 22 will transfer control to a service routine corresponding to the interrupt that occurred, such as the routine depicted in FIG. 3, to be described. Upon completion of the interrupt service routine, the background operations will resume at the point they were interrupted.

Figure 3:
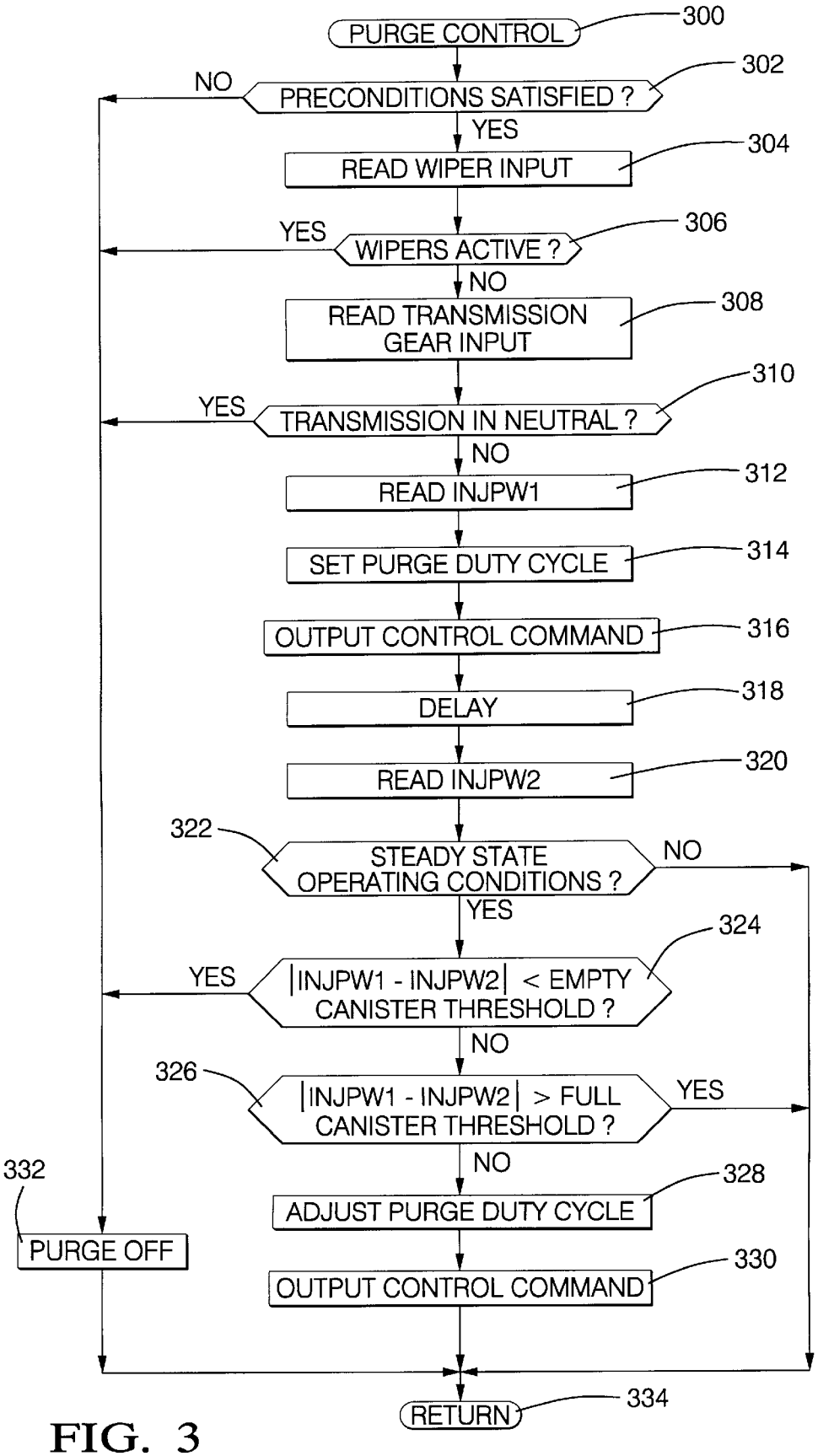

As stated, one of the interrupts enabled at step 204 is a time-based purge control interrupt which executes approximately every 100 milliseconds while the ECM 22 is activated. When a purge control interrupt occurs, the microprocessor transfers control to a purge control routine as illustrated in FIG. 3. The purge control routine processes a plurality of input signals, determines a desired purge rate as a function of the input signals, and outputs a purge control command to drive the purge valve to a desired degree of opening. The purge control routine starts at a step 300 and proceeds to perform a purge precondition check at a step 302 to determine if the preconditions necessary to enable canister purging are satisfied. In this embodiment, engine coolant temperature, as determined by a conventional engine coolant temperature sensor (not shown), must be above 50 degrees Celsius and the vehicle must be in closed-loop fuel control before canister purge is enabled. For example, closed-loop fuel control operation is activated upon completion of a warm-up period following an engine cold start to ensure any oxygen sensor on which the system relies is catalytically active. It is desirable to ensure closed-loop fuel operation before enabling canister purge to prevent vehicle driveability problems, such as engine stalls, that may occur as a result of purging during open-loop fuel operation when closed-loop control responsive to purge level is inactive. If the purge preconditions are not satisfied the purge system is deactivated at a step 332 and control is returned to the background operations of FIG. 2 at a next step 334.

If the purge preconditions are satisfied as determined at step 302, the routine proceeds to determine if a high humidity operating condition exists by first determining if the windshield wipers are active at steps 304–306. Active wipers are used to indicate, using hardware already available on conventional automotive vehicles, whether a high humidity condition is present, which leads to moisture intrusion in the fuel vapor canister and deteriorates the fuel vapor adsorbing material. First, a windshield wiper switch state is determined at a step 304 by monitoring a windshield wiper switch input signal WIPER. At a next step 306, a check is performed to determine if the windshield wiper system is "active". The determined state of the wiper switch is compared at step 306 to a predetermined switch state corresponding to an active state of the windshield wiper system. If the determined wiper switch state corresponds to the predetermined switch state, which may be any "on" state, or alternatively, may be limited in a variable speed wiper system to all but a low speed state, then the wiper system is categorized as currently active and the vehicle operating conditions are categorized as high humidity conditions. The purge system is deactivated to prevent moisture from entering the fuel vapor canister and reducing the capacity of the fuel vapor adsorbing material at a step 332. Following deactivation of the purge system at step 332, control is returned to the background operations of FIG. 2 at step 334.

If the determined wiper switch state does not correspond to the predetermined wiper state, as determined at step 306, the routine proceeds to further determine if a high humidity operating condition exists by analyzing conditions indicating the vehicle may be in a car wash via steps 308–310. First, a signal indicating the current state of the transmission, TRANS, is sampled at a step 308. The current state of the transmission is determined by monitoring the state of the transmission pressure switches (not shown) of transmission 20 (FIG. 1), as is generally understood in the art. If the current transmission state is neutral, as determined at a next step 310, it is assumed the vehicle is operating in a car wash and the purge system is disabled at step 332 to prevent moisture from the high humidity operating conditions of the vehicle car wash from entering the fuel vapor canister and reducing the capacity of the fuel vapor adsorbing material. Following deactivation of the purge system at step 332, control is returned to the background operations of FIG. 2 at step 334.

Returning to step 310, if the transmission is determined not to be in a neutral state, a fuel vapor level check is next carried out at steps 312–318 to determine the level of fuel vapor contained within the fuel vapor canister. First, a base injector pulse width, INJPW1, is determined at a step 312 by averaging the pulse width of the injector drive command INJPW issued by ECM 22 to fuel injector driver 24 (FIG. 1) over a predetermined period of time. The base injector pulse width represents the injector pulse width required to maintain the stoichiometric air/fuel ratio before canister purging is enabled, at which point the fueling mixture contains only fuel and exhaust gas. Next, a desired purge control signal duty cycle is determined at a step 314. The desired duty cycle is determined by ECM 22 as a function of throttle valve position as indicated by input signal TPOS. For a given throttle valve position a calibrated maximum duty cycle threshold, representing the maximum degree of opening of purge valve 42 (FIG. 1) possible for the given throttle valve position without inducing driveability problems, is stored in a conventional look-up table in the ECM 22's ROM. Vehicles equipped with a variable speed wiper system have a second look-up table in which the calibrated maximum duty cycle threshold is a function of throttle valve position and wiper speed, as sampled at step 304, such that the maximum calibrated duty cycle threshold allowed when the windshield wipers are active is reduced as a function of the indicated wiper speed to reduce the amount of moisture entering the fuel vapor canister. At a next step 316, the desired duty cycle is issued by ECM 22 to purge valve driver 40 which converts the desired duty cycle to a purge drive signal, as described previously. The purge drive signal is applied to purge valve 42, driving the purge valve to open to a corresponding degree of opening and allowing fuel vapor to pass from the fuel vapor canister 34 and into the engine intake manifold 18. A delay is instituted at a step 318, such as a 2 second delay, to allow time for the purge system to stabilize. At a next step 320, a post-purge injector pulse width, INJPW2, is recorded by averaging the pulse width of the injector drive command INJPW issued by ECM 22 to fuel injector driver 24 (FIG. 1) over a predetermined period of time. The post-purge injector pulse width, INJPW2, represents injector pulse width required to maintain a stoichiometric air/fuel ratio after canister purging has been enabled, at which point the fueling mixture contains fuel, fuel vapor, and exhaust gas. As the amount of fuel vapor added to the mixture increases, the amount of fuel required to maintain the stoichiometric air/fuel ratio will decrease, resulting in a decrease in fuel injector pulse width. Accordingly, the change in injector pulse width before and after canister purging is enabled can be used to estimate the amount of fuel vapor added to the fueling mixture as a result of canister purging, as well as a corresponding estimated level of fuel vapor within the canister, in a manner to be described.

Next, a check is performed to determine if the vehicle is operating under steady state operating conditions, such as vehicle idle or vehicle cruise at substantially constant speed, at a next step 322. Steady state operating conditions are desirable to more accurately estimate the level of fuel vapor contained within the fuel vapor canister 34 (FIG. 1). Under steady state operating conditions it is assumed that a change in injector pulse width is caused by the addition of fuel vapor to the fueling mixture comprised of intake air and injected fuel. If the vehicle is not operating under steady state operating conditions, the injector pulse width may change in response to other vehicle operating parameters, such as vehicle speed or engine load, resulting in an inaccurate calculation of the change in injector pulse width due to the addition of fuel vapor, and correspondingly, an inaccurate estimation of fuel vapor level contained within the canister. If the vehicle is determined not to be operating under steady state operating conditions the purge system remains active with the desired duty cycle determined at step 314 and the routine proceeds directly to step 332 where control is returned to the background operations of FIG. 2.

If the vehicle is determined at the step 322 to be operating under steady state operating conditions, a change in injector pulse widths, determined by taking the difference between the base injector pulse width and the post-purge injector pulse width (INJPW1–INJPW2), is compared to a calibrated empty canister threshold corresponding to a fuel vapor canister that contains essentially no fuel vapor, such as a five percent (5%) change in injector pulse width, at a next step 324. If the change in injector pulse width is less than the calibrated empty canister threshold, it is assumed the fuel vapor canister 30 is substantially fully purged and the routine proceeds to deactivate the purge system at a step 332 to minimize purge system component deterioration due to purging of a substantially fully purged canister. Next, control is returned to the background operations of FIG. 2 at step 334.

Returning to step 324, if the change in injector pulse width is greater than the calibrated threshold, a check is made at a step 326 to determine if the fuel vapor canister is full. At step 326, the change in injector pulse width is compared to a calibrated full canister threshold corresponding to a fuel vapor canister that contains essentially its maximum capacity of fuel vapor, such as a forty percent (40%) change in injector pulse width. If the change in injector pulse width is greater than the calibrated "full canister" threshold it is assumed that the canister contains a level of fuel vapor great enough to sustain the current desired purge rate without causing purge system deterioration. The purge system remains active with the desired duty cycle determined at step 314 and the routine proceeds directly to step 334 where control is returned to the background operations of FIG. 2. If the change in injector pulse width is less than the calibrated full canister threshold as determined at step 326, the routine proceeds to adjust the desired duty cycle at a next step 328 as a function of the change in injector pulse width, such that the adjusted duty cycle corresponds to a maximum degree of opening of the purge valve 42 (FIG. 2) that can be sustained for the estimated level of fuel vapor contained within the canister without causing the fuel vapor canister 30 to become substantially purged, preventing purge system deterioration due to purging of a substantially purged canister. The duty cycle is adjusted as a function of throttle valve position and change in injector pulse width by decreasing the desired purge signal duty cycle to a calibrated threshold contained in a conventional look-up table stored in the ECM 22's ROM. Next, the adjusted duty cycle is issued by ECM 22 to purge valve driver 40 which converts the adjusted duty cycle to a purge drive signal, as described previously. The purge drive signal is applied to purge valve 42, driving the purge valve to open to a corresponding degree of opening and allowing fuel vapor to pass from the fuel vapor canister 34 and into the engine intake manifold 18. After the adjusted duty cycle is commanded at step 330, control is returned to the background operations of FIG. 2 at step 334.

The canister purge control routine of FIG. 3 can be programmed to execute only in response to an initial control decision to activate canister purging, or in an alternative embodiment, the canister purge control routine can be programmed to execute periodically while the canister purge system is active. Executing the canister purge control routine periodically while the purge system is active allows for adjustment or deactivation of the canister purge system in response to fluctuations in operating conditions. For example, an initial high humidity check may indicate the wipers are not active, indicating the vehicle is not operating in a rainy condition, and the canister purge system may be activated accordingly. Upon subsequent execution of the canister purge control routine, the high humidity check may indicate the wipers are active, indicating the vehicle has entered a rainy condition, and canister purging may be disabled to prevent moisture intrusion and deterioration of the fuel adsorbing material. Similarly, the level of fuel vapor contained within the canister may increase or decrease throughout an ignition cycle in response to the vehicle's operating conditions. Periodic execution of the canister purge control routine would provide for periodic adjustment of the purge control signal duty cycle in response to fluctuations in the estimated level of fuel vapor. The inventor's further intend that the high humidity checks and fuel vapor level check may be used in combination with each other, or independently, through implementation of minor alterations to the operations of FIGS. 2–3, as would be evident to a person of ordinary skill in the art, within the scope of this invention.

The preferred embodiment for the purpose of explaining this invention is not to be taken as limiting or restricting the invention since many modifications may be made through the exercise of ordinary skill in the art without departing from the scope of the invention.

The embodiments of the invention in which a property or privilege is claimed are described as follows:

1. A method for selectively operating an automotive purge control system used to purge fuel vapors from a vapor collection apparatus, to minimize deterioration of the purge control system, comprising the steps of:

identifying a high humidity condition which, when present, leads to a deterioration condition in an active purge control system;

monitoring an input signal indicating a presence of the identified operating condition; and adjusting the purge control system operation to minimize the deterioration thereof when the monitored input signal indicates a presence of the identified operating condition.

2. A method for regulating the operation of an automotive purge control system responsive to a purge control signal to minimize deterioration of purge system components, comprising the steps of:

monitoring an input signal indicating an active state of an automotive windshield wiper system;

identifying when the monitored input signal indicates a presence of a high humidity operating condition which, when present, leads to a deterioration condition in the purge control system;

adjusting the purge control signal to regulate operation of the purge control system to minimize purge control system deterioration when a presence of the high humidity operating condition is indicated; and applying the adjusted purge control signal to the purge control system to regulate operation of the purge control system to minimize purge control system deterioration.

3. A method for regulating the operation of an automotive purge control system responsive to a purge control signal to minimize deterioration of purge system components, comprising the steps of:

monitoring an input signal indicating a neutral gear of an automotive transmission;

identifying when the monitored input signal indicates a presence of a high humidity operating condition which, when present, leads to a deterioration condition in the purge control system;

adjusting the purge control signal to regulate operation of the purge control system to minimize purge control system deterioration when a presence of the high humidity operating condition is indicated; and applying the adjusted purge control signal to the purge control system to regulate operation of the purge control system to minimize purge control system deterioration.

4. A method for operating an automotive purge control system responsive to a purge control signal, used to purge fuel vapors from a vapor collection apparatus at a desired purge rate, to minimize degeneration of the purge control system, comprising the steps of:

monitoring an input signal indicating an active state of an automotive windshield wiper system thereby indicating a presence of a high humidity condition;

establishing a desired purge rate as a function of the monitored input signal;

determining a purge control signal as a function of the desired purge rate; and applying the determined purge control signal to the purge control system to operate the purge control system at the desired purge rate to minimize degeneration of the purge control system.

5. A method for operating an automotive purge control system responsive to a purge control signal, used to purge fuel vapors from a vapor collection apparatus at a desired purge rate, to minimize degeneration of the purge control system, comprising the steps of:

monitoring an input signal indicating a neutral gear of an automotive transmission thereby indicating a presence of a high humidity condition;

establishing a desired purge rate as a function of the monitored input signal;

determining a purge control signal as a function of the desired purge rate; and applying the determined purge control signal to the purge control system to operate the purge control system at the desired purge rate to minimize degeneration of the purge control system.

6. The method of claim 1, wherein the monitored input signal is a signal indicating an active state of an automotive windshield wiper system.

* * * * *